United States Patent [19]

Lenk

[11] Patent Number: 4,867,385

[45] Date of Patent: Sep. 19, 1989

[54] METHOD AND APPARATUS FOR THREADING AN ADVANCING YARN ONTO A WINDING BOBBIN TUBE

[75] Inventor: Erich Lenk, Remscheid, Fed. Rep. of Germany

[73] Assignee: Barmag, AG, Remscheid, Fed. Rep. of Germany

[21] Appl. No.: 175,151

[22] Filed: Mar. 30, 1988

[30] Foreign Application Priority Data

Apr. 8, 1987 [DE] Fed. Rep. of Germany ..... 3711893

[51] Int. Cl.[4] ..... B65H 67/04

[52] U.S. Cl. ..... 242/18 A; 242/18 PW

[58] Field of Search ..... 242/18 A, 18 PW, 35.5 A

[56] References Cited

U.S. PATENT DOCUMENTS

| | | | |
|---|---|---|---|
| 2,905,402 | 9/1959 | Foller et al. | 242/18 A |
| 2,957,635 | 10/1960 | Bisbe | 242/18 A |
| 3,001,732 | 9/1961 | Hill, Jr. et al. | 242/18 A |
| 3,090,570 | 5/1963 | Cunningham et al. | 242/18 A |
| 3,109,602 | 11/1963 | Smith | 242/18 A |
| 3,118,625 | 1/1964 | Kuster | 242/18 A |
| 3,165,274 | 1/1965 | De Priest | 242/18 A |
| 3,279,904 | 10/1966 | Russell et al. | 242/18 A |
| 3,334,827 | 8/1967 | Jackson | 242/18 A |
| 3,342,428 | 9/1967 | Smiley, Jr. | 242/18 A |
| 3,409,238 | 11/1968 | Campbell et al. | 242/18 A |
| 3,999,715 | 12/1976 | Schippers et al. | 242/18 A |
| 4,002,307 | 1/1977 | Turk et al. | 242/18 A |
| 4,033,519 | 7/1977 | Abe et al. | 242/18 A |
| 4,083,505 | 4/1978 | Burkhardt | 242/18 PW |
| 4,099,679 | 7/1970 | De Baker et al. | 242/18 PW |
| 4,283,019 | 8/1981 | Gujer | 242/18 A |
| 4,398,676 | 8/1983 | Koppen et al. | 242/18 A |
| 4,431,138 | 2/1984 | Schiminski et al. | 242/18 A |
| 4,474,337 | 10/1984 | Schiminski et al. | 242/18 PW |
| 4,585,181 | 4/1986 | Schippers et al. | 242/43 A |

FOREIGN PATENT DOCUMENTS

| | | |
|---|---|---|
| 0005664 | 11/1979 | European Pat. Off. . |
| 0018577 | 4/1980 | European Pat. Off. . |
| 2353202 | 5/1975 | Fed. Rep. of Germany . |
| 2346272 | 10/1977 | France . |

*Primary Examiner*—Stanley N. Gilreath

*Attorney, Agent, or Firm*—Bell, Seltzer, Park & Gibson

[57] ABSTRACT

A method and apparatus is disclosed for threading an advancing yarn onto a rotating empty bobbin tube. The yarn is withdrawn by a yarn withdrawal means, while being guided into contact with the periphery of the rotating bobbin tube which is moving in the same direction as the advancing yarn, and which has a surface speed about the same as the yarn advancing speed. The speed of the yarn is then reduced at a location between the empty bobbin and the yarn withdrawal means, such as by contacting the yarn with a braking guide, to cause the yarn to slacken and thus form a lap on the empty bobbin, and to thereby cause the yarn to be caught by and then wound upon the rotating empty bobbin tube.

8 Claims, 3 Drawing Sheets

METHOD AND APPARATUS FOR THREADING AN ADVANCING YARN ONTO A WINDING BOBBIN TUBE

FIELD OF THE INVENTION

This invention relates generally to a method and apparatus for threading a yarn onto an empty bobbin tube supported on a rotating winding spindle and wherein the yarn is brought into circumferential contact with the rotating bobbin tube so that the yarn is caught on the tube and is then wound thereupon. A method and apparatus of this general type is disclosed in U.S. Pat. No. 4,431,138 to Schiminski et al.

BACKGROUND OF THE INVENTION

In winding operations wherein a yarn is to be caught on the empty bobbin tube of a winding spindle, and with the yarn speed and the surface speed of the empty tube being the same, special means must be provided on the empty tube so as to improve the catching effect and to obtain the required catching reliability, which catching reliability should be more than 99 percent to be acceptable in practical operations. For this purpose, it is suggested in U.S. Pat. No. 4,099,679 that the usual circumferential groove of the empty tube be additionally provided with a transfer groove. U.S. Pat. No. 4,033,519 suggests that a greater catching reliability can be accomplished by rotating the surface of the empty tube in a direction opposite the direction in which the yarn is being advanced. However, in the spinning of yarns formed of man-made filaments, it has been found that the catching reliability of these known methods drastically decreases when yarn speeds of higher than 4,000 meters per minute are employed, even with highly skilled operators. Thus these known methods are not technically reliable for winding yarns of man-made filaments at these high yarn speeds.

SUMMARY OF THE INVENTION

With the foregoing in mind, it is an object of the present invention to provide a highly reliable method and apparatus for threading an advancing yarn of man-made filaments onto an empty tube of the winding system and wherein the yarn is advancing at a high constant speed.

The method and apparatus of the present invention departs from the above described techniques wherein the yarn and the surface of the empty tube are brought in contact with each other while running in the same or opposite directions and the yarn is clamped in a catching groove of the empty tube by applying firm locking forces to the yarn. In contrast to these prior art methods, the present method and apparatus does not rely upon the concept that the clamping and locking forces must be made sufficiently large to increase the catching reliability. Rather, the present method and apparatus includes the steps of withdrawing the advancing yarn to a yarn withdrawal means and so that the advancing yarn contacts a portion of the periphery of the rotating empty bobbin tube which is moving in the same direction as the advancing yarn. The speed of the advancing yarn between the winding tube and the withdrawal means is reduced after the yarn is brought in circumferential contact with the empty bobbin tube so that the yarn slackens and forms a lap on the tube and is thereby caught on the tube.

In accordance with one embodiment of the present invention, the speed of the advancing yarn is reduced by contacting the advancing yarn with a yarn brake positioned between the empty tube and the withdrawal means and this braking action on the yarn can be accompanied by deflection of the yarn between the tube and the withdrawal means so that additional friction is applied to the yarn by reason of the deflection.

The present method can also be employed in a wasteless winding machine provided with two winding spindles which are mounted on a rotatable revolver, and wherein the spindles are selectively moved between a winding position and a doffing position. In this embodiment, the advancing yarn is wound onto a rotating first bobbin tube positioned at the winding position, and the yarn is traversed to form a cross wound package and so that at least one end portion of the bobbin tube is substantially free of yarn windings and has a diameter substantially less than the diameter of the wound package. Upon the first bobbin tube becoming full, the revolver is rotated to laterally withdraw the full bobbin and concurrently move an empty rotating second bobbin tube to the winding position and so that the advancing yarn contacts a portion of the periphery of the empty rotating second bobbin tube which is moving in the same direction as the advancing yarn. The advancing yarn is then axially displaced so that it is wound on the reduced diameter end portion of the bobbin tube. This causes the advancing yarn to slacken and form a lap on the rotating empty bobbin tube, to thereby cause the yarn to be caught by the rotating empty bobbin tube and commence being wound thereon.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENTS

Figure 1:
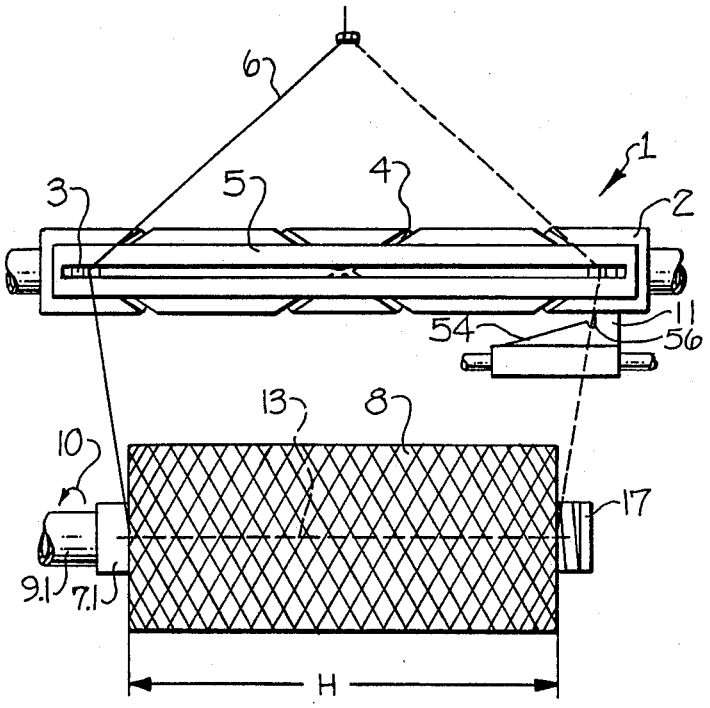
FIG. 1 is a somewhat schematic front elevational view of a winding apparatus embodying the features of one embodiment of the present invention.

Referring more particularly to the embodiment of the present invention illustrated in FIGS. 1–5, a winding take-up apparatus is disclosed which includes a yarn traversing system, broadly indicated at 1, including a cross-spiralled shaft 2 and a traversing yarn guide 3. The traversing yarn guide 3 reciprocates in grooves 4 of the cross-spiralled shaft 2 and is guided back and forth in a straight guide slot formed in a guide plate 5. The traversing yarn guide 3 directs the yarn 6 onto a yarn winding bobbin tube 7.1 to form a cross-wound package 8. As best seen in FIG. 1, the two opposite end portions of the tube 7.1 are substantially free of yarn windings.

Figure 2:
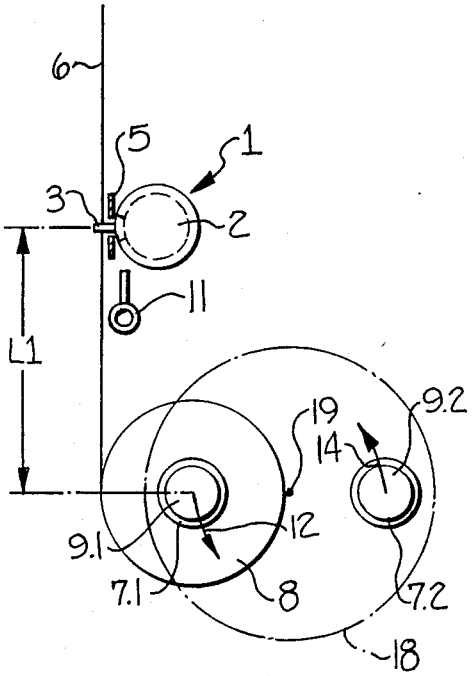
FIG. 2 is a side elevational view of the apparatus shown in FIG. 1.

The tube 7.1 is drivingly supported on a winding spindle 9.1. The winding spindle 9.1 is driven in a manner not shown, in the direction of rotation of the arrow 10 in FIG. 1. During the winding operation, a second winding spindle 9.2 with an empty tube 7.2 drivingly supported thereon is positioned in a standby position (FIG. 2). Also positioned in a standby position is an auxiliary yarn guide 11 which operates in a manner described below.

Figure 3:
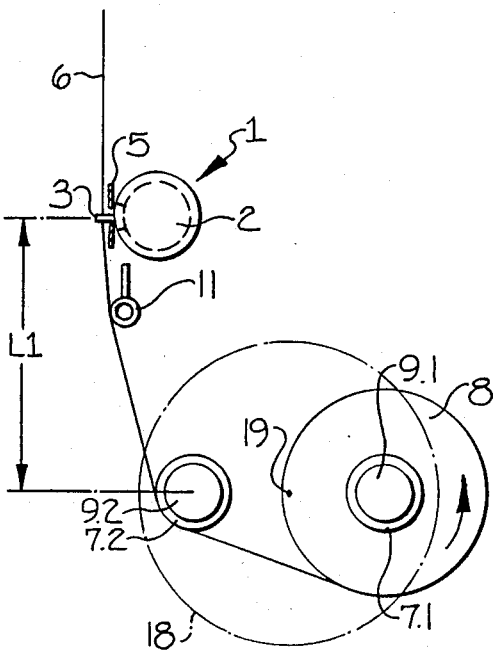
FIG. 3 is a view similar to FIG. 2 but showing the winding spindle with the full package and the winding spindle with the empty tube in reversed position.
Figure 4:
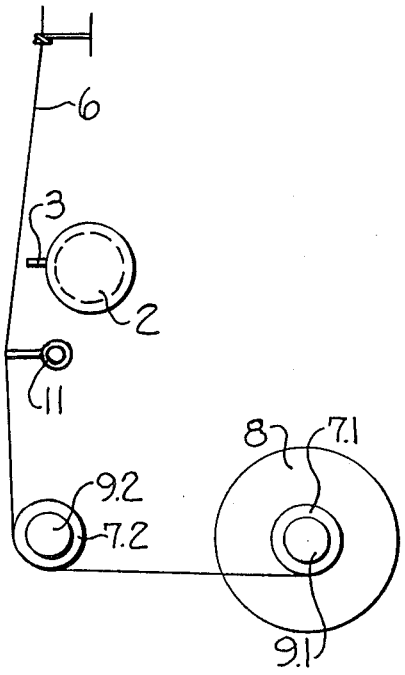
FIG. 4 is a view similar to FIG. 2 but showing the yarn moved out of the traversing yarn guide.
Figure 5:
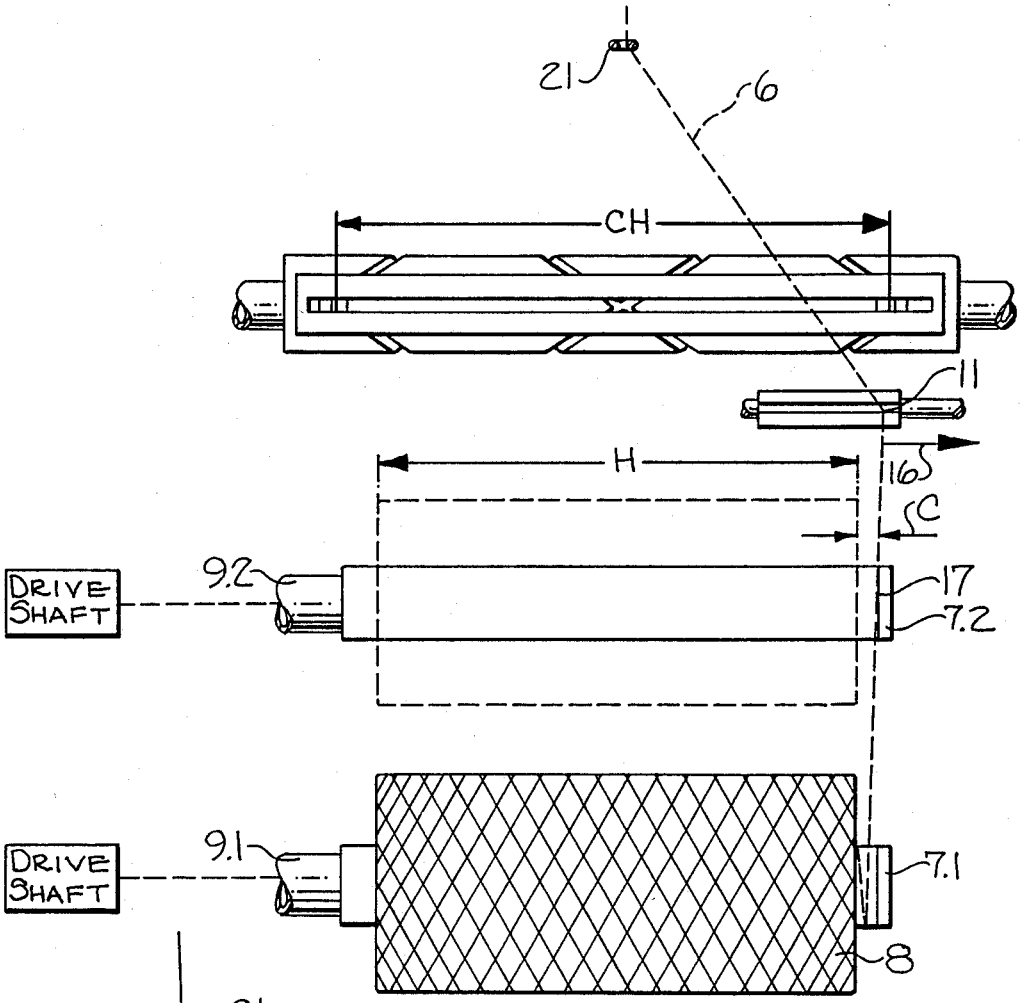
FIG. 5 is a view similar to FIG. 1 but showing the spindle with the full package moved to a position below the spindle with the empty tube thereon.

Upon or shortly before completion of the winding operation, when the package 8 is almost full, the winding spindle 9.1 is moved away from the yarn traversing system in the direction of the arrow 12 in FIG. 2. Concurrently therewith, the winding spindle 9.2 is rotated by a drive, not shown, and moved with an empty tube 7.2 thereon in the direction of arrow 14 in FIG. 2 and into the plane of the advancing yarn 6 to an active end position, as shown in FIGS. 3 and 4. For this purpose, the two winding spindles 9.1 and 9.2 are supported on a revolver 18 which is rotatable about an axis 19.

The auxiliary yarn guide 11 is then moved into the plane of the advancing yarn 6, as illustrated in FIG. 4, so that the yarn moves onto the slope 54 of the auxiliary yarn guide 11 and is thereby lifted out of the traversing yarn guide 3 and caught in the yarn guide slot 56, as illustrated in dotted lines in FIG. 1. With movement of the auxiliary yarn guide 11 in the direction of the arrow 16 in FIG. 5, the yarn 6 is moved out of the normal range of winding width H by the distance C, and into the normal plane of a yarn catching groove or notch 17 which is provided at one of the unwound end portions of each of the tubes 7.1 and 7.2. During this axial movement the yarn 6, which has until then been wound on package 8 on the spindle 9.1, drops from the cross-wound package so that it is then wound only on the end portion of the tube 7.1 on the spindle 9.1.

In contrast to the cited known methods, the yarn 6 is thereby purposely dropped from the full package 8 as part of the thread-up procedure. As a result, the takeup speed of the yarn is reduced in accordance with the diameter ratio between the empty tube and the full package 8. At the same time, the looping on the empty tube 7.2 and, consequently, also the entrainment by the empty tube 7.2 is increased. To enhance the entrainment, it may be desirable to also provide the yarn catching notch 17 on the empty tube 7.2, as illustrated. The yarn catching notch 17 also exerts lateral clamping forces on the yarn. These measures contribute to a slackening of the yarn between the winding spindle 9.2 with the empty tube 7.2 and the winding spindle 9.1 with the full package 8. However, as seen in FIG. 4, since the yarn 6 then loops about the empty tube 7.2 on the spindle 9.2 at a considerable looping angle, and since the winding spindle 9.2 rotates faster than the winding spindle 9.1, the yarn forms a lap on the empty tube 7.2 and is consequently entrained by an empty tube 7.2, the surface speed of which equals the yarn speed by amount and direction. As a result, the yarn tears between the winding spindle 9.1 and the winding spindle 9.2 since the surface speed of the package 8 is equal to the yarn speed but not equal to the surface speed of the tube 7.1 on the winding spindle 9.1, on which the yarn is now wound.

As has been mentioned in the described method, the yarn 6 was also placed in the catching notch 17 on the empty tube 7.2 of the winding spindle 9.2. This action further promotes the formation of laps and may be useful in particular at yan speeds of between 3,000 and 5,000 meters per minute. As the yarn speed increases, the tendency of the yarn to form laps increases so much that one can do without a yarn catching groove 17 above a particular winding speed limit which can be easily determined. This limit is dependent on the yarn speed. However, this limit is also determined by the circumference of the empty tube, as well as the properties of the yarn being wound. Synthetic filament yarns which include a very large number of individual filaments with a very low diameter have a greater tendency to form laps than a synthetic filament yarn with only a very few individual filaments of large denier.

The present method provides a very special advantage in that in all wastelessly operating take-up machines in which the yarn is alternately wound on two winding spindles, there exists the problem that the yarn, which is torn off from the full package, is propelled around by the full package as it slows down, and in so doing strikes against the new package being formed. This action of the trailing end of the fully wound package leads to a damage to the new package and even an interruption of the winding operation. This disadvantage is avoided in accordance with the present invention in that the torn-off yarn end lies on the empty end portion of the tube with a very small diameter extending outwardly from one end of the package, and consequently the trailing end of the yarn does not project outwardly beyond the surface of the full package 8.

FIGS. 6–10 illustrate another embodiment of the method of the present invention, carried out in association with a winding apparatus which has only one winding spindle 9. In this embodiment, the yarn is guided to the traversing system 1 from a yarn guide 21 which forms the apex of a traversing triangle. The traversing system 1 includes two oppositely rotating blades 37, 38, as well as a guide edge 39. Such a yarn traversing system is described in German Patent DE-OS No. 35 16 475 and U.S. Pat. No. 4,585,181.

Located below the yarn traversing system 1 is an auxiliary yarn guide 11 which corresponds substantially to the yarn guide shown in the embodiments of FIGS. 1–5. In operation, the package formed on the winding spindle 9 and the empty tube 7 is driven on its circumference by a contact roll or drive roll 20. Further provided is a shaft drive motor, which directly drives the winding spindle 9. Additionally, the take-up machine is provided with a pivoting arm 32 which pivots about an axis 33 and which mounts a yarn braking guide 34 on its free end. The axis of rotation 33 of the arm 32 is parallel to the winding spindle 9. In addition to its pivoting motion, the arm 32 can also perform an axial movement parallel to the winding spindle 9.

Figure 6:
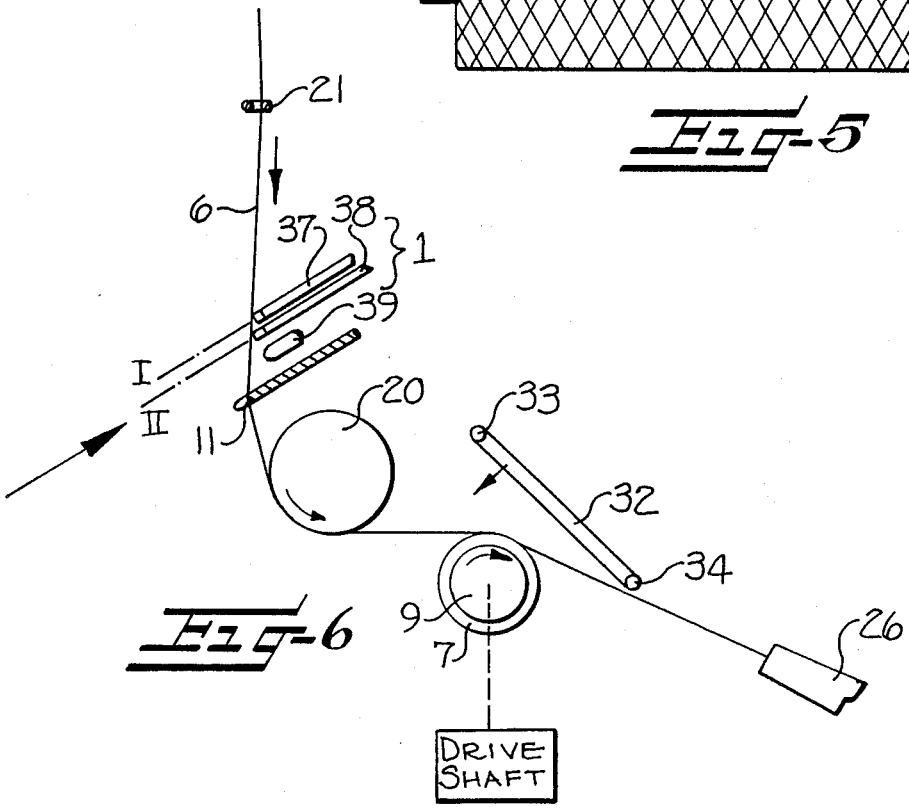
FIGS. 6 and 7 are somewhat schematic side elevational views of a different type of winding apparatus and showing successive steps of the method for threading the yarn on an empty tube.

FIG. 6 illustrates the threading of a new yarn 6 onto the empty tube 7. The winding spindle 9 is in a doff position, in which it is not in contact with the contact drive roll 20. In this position, the winding spindle 9 is driven by its shaft drive motor. The yarn 6 extending from the yarn guide 21 is moved outwardly by the auxiliary yarn guide 11 so that it is not reciprocated by the oppositely rotating blades 37, 38. The leading end of yarn 6 has been separated from the full package, not shown, and is being withdrawn by a suction nozzle 26. The yarn 6 is guided so that its direction of movement corresponds to the direction of rotation of the empty tube 7 in the area in which the yarn is in contact with the empty tube. The empty tube 7 may be provided with a yarn threading slot in an end portion thereof, if desired.

Figure 7:
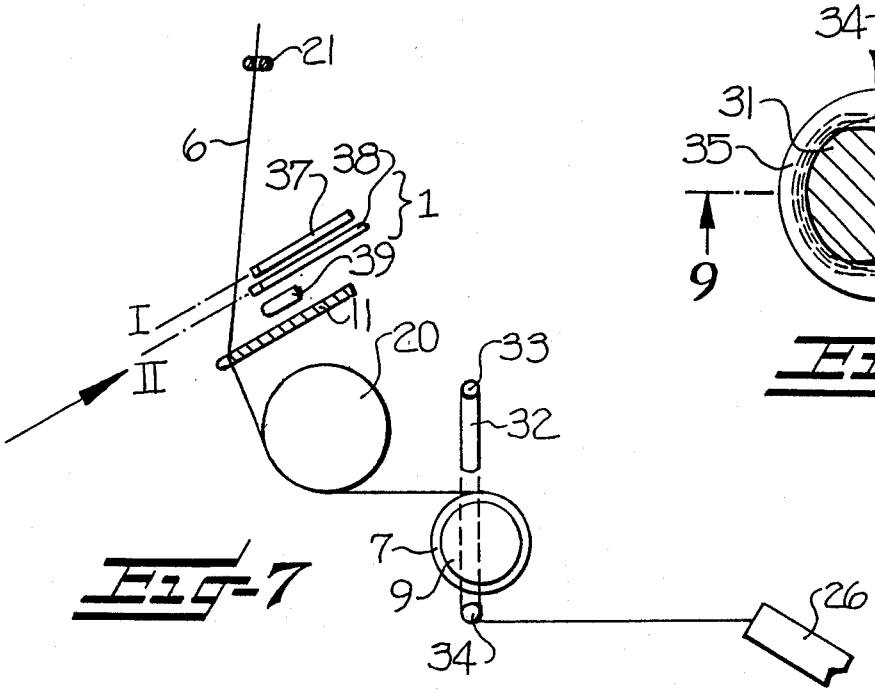

As illustrated in FIG. 7, the pivoting arm 32 is rotated from the position shown in FIG. 6 to a substantially vertical position. When rotated to this position, the yarn braking guide 34 moves around and below the empty tube 7, and is positioned between the winding spindle 9 and the suction nozzle 26. In this position, the looping angle of the yarn on both the empty tube 7 and the yarn braking guide 34 increases. As a result of this greater looping, the yarn is already entrained around the empty tube 7 with a reduced slip and simultaneously braked on the yarn guide 34. Consequently, the yarn slackens between the empty tube 7 and the yarn braking guide 34 and forms a lap on the winding tube 7 so that the yarn is thereby caught on the empty tube 7.

Figure 10:
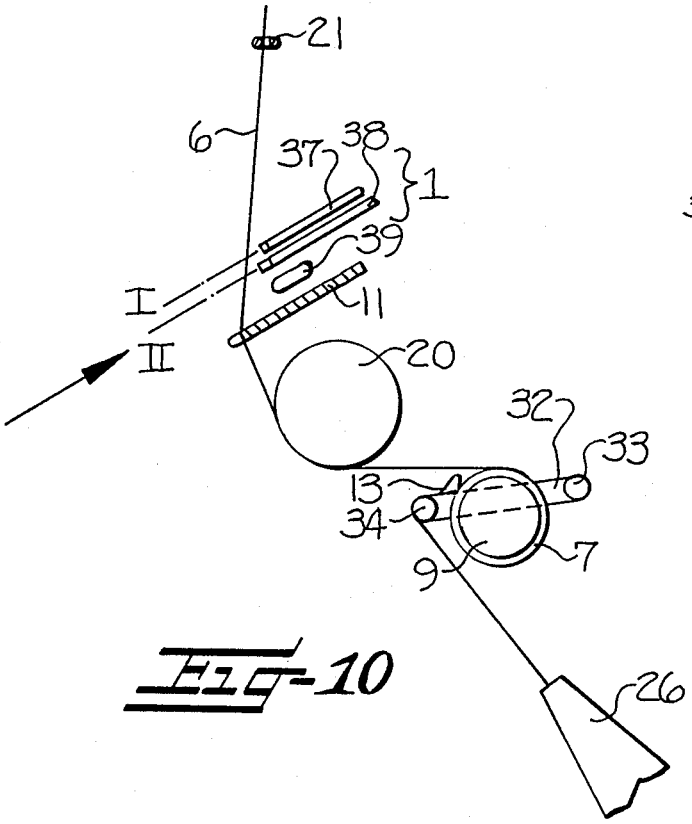
FIG. 10 is a view similar to FIG. 7 but showing a modification of the method.

By providing a different design and arrangement of the pivot axis 33 with the arm 32 and the yarn braking guide 34, a looping angle of the yarn on the empty tube of between about 180 to 270 degrees or greater can be obtained, as illustrated in FIG. 10. In this arrangement, the yarn suction nozzle 26 is positioned so that the yarn is guided between the yarn braking guide 34 and the suction nozzle 26 without contacting the empty tube 7. This greater amount of looping, of 270 degrees or more, about the empty tube 7 results in a greater looping and braking effect of the yarn on the guide 34. Furthermore, the yarn is already close to the yarn segment which advances to the empty tube 7. When the yarn now slackens between the empty tube 7 and the yarn braking guide 34, it is very likely that the slackening yarn segment extending between the tube 7 and the yarn braking guide 34 and indicated at 13, tends to place itself on the empty tube 7 and is wound under the advancing yarn. This is the typical procedure of a lap formation which is, in the present instance, relied upon and utilized for the reliable catching of the yarn on the empty tube 7.

A yarn groove 35 is preferably provided on the yarn braking guide 34 (FIGS. 8 and 9), with different frictional properties, to further enhance the braking effect of the yarn braking guide 34. In the peripheral portion 31 (FIG. 8) of the groove 35 a relatively small sector angle is provided with a rounded bottom to form a low frictional surface. The yarn is in contact with the portion 31 as long as it loops around the yarn braking guide at a small angle, as shown in FIG. 7. To this end, the peripheral portion 31 is so positioned that it contacts the yarn first, when the arm 32 is pivoted from the position shown in FIG. 6 to the position shown in FIG. 7.

Figure 8:
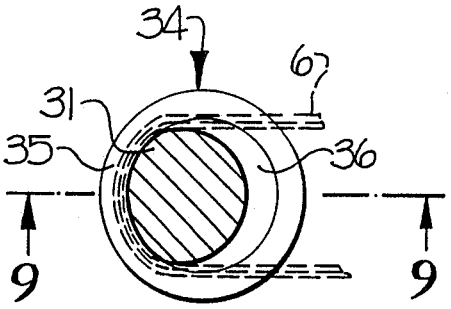
FIG. 8 is a vertical sectional view through the yarn brake guide shown in FIG. 7.
Figure 9:
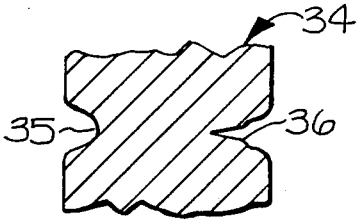
FIG. 9 is a horizontal sectional view through the yarn brake guide shown and substantially along the line 9—9 in FIG. 8.

The peripheral portion 31 with the rounded bottom in the groove 35 is followed by a cutting notch 36 which is crescent-shaped as seen in FIGS. 8–9 in that it extends with increasing and then decreasing depth from the one end of the cutting notch 36 to the other. The cutting notch 36 thus extends over a relatively large sector angle, into which the yarn enters, when the pivoting arm 32 and the yarn braking guide 34 reach their extreme position, as shown in FIG. 7. Since the yarn enters into the cutting notch 36, a strong lateral braking force is exerted on the yarn and this force may, depending on the design of the cutting notch 36, be of such an extent that the yarn breaks or is cut.

Thus, the slackening of the yarn between the yarn guide 34 and the empty tube 7 is further promoted so that the intended lap formation will certainly occur with great reliability on the empty tube 7. Further, the slackening of the yarn may also be promoted in that the empty tube 7 may be provided with a yarn catching notch in its circumference. When the yarn guide 21, the auxiliary yarn guide 11, the groove 35 on the yarn braking guide 34, and the suction nozzle 26 are axially aligned and positioned so that the yarn enters the yarn catching notch of the empty tube 7, the notch will exert a lateral clamping force on the yarn. Consequently, as the looping of the yarn on the empty tube 7 increases, the yarn will be in firm locking engagement with the tube so that there is no longer a slip on the empty tube 7. The tension which the empty tube 7 exerts on the yarn is thus increased and the tension between the yarn guide 34 and the empty tube 7 is correspondingly reduced.

In the drawings and specification there have been set forth the best modes presently contemplated for the practice of the present invention, and although specific terms are employed, they are used in a generic and descriptive sense only and not for purposes of limitation, the scope of the invention being defined in the claims.

I claim:

1. A method of threading a yarn which is advancing at a constant speed onto a rotating empty bobbin tube and comprising the steps of withdrawing the advancing yarn to a yarn withdrawing means and while guiding the advancing yarn into contact with a portion of the periphery of the rotating empty bobbin tube which is moving in the same direction as the advancing yarn, and then reducing the speed of the advancing yarn between the rotating empty bobbin tube and the withdrawal means and so that the advancing yarn slackens and forms a lap on the rotating empty bobbin tube to thereby cause the yarn to be caught by the rotating tube and commence being wound thereon, said reducing step including contacting the advancing yarn with a yarn brake at a location between the rotating empty bobbin tube and the withdrawal means.

2. The method as defined in claim 1 wherein the step of contacting the advancing yarn with a yarn brake includes moving said yarn brake into contact with the advancing yarn and so to deflect the yarn about a portion of the circumference of the rotating bobbin tube.

3. The method as defined in claim 2 wherein the step of contacting further includes deflecting the yarn circumferentially about the rotating bobbin tube to angle of between about 180° to 270°, and so that the yarn advances from the brake to said withdrawal means without contacting said tube.

4. The method as defined in claim 1 wherein the empty bobbin tube is rotated at a rotational speed such that its surface speed is about the same as the yarn advancing speed.

5. The method as defined in claim 1 including the further step of providing the rotating bobbin tube with a yarn catching notch in the portion of the periphery of the tube which is contacted by the advancing yarn and so that the advancing yarn will likely be caught by the notch.

6. An apparatus for threading a yarn advancing at a constant speed onto a rotating empty bobbin tube and comprising means for rotatably mounting a spindle which is adapted to coaxially receive a yarn bobbin tube, drive means for rotating said spindle and associated bobbin tube, yarn traversing means for traversing an advancing yarn to form a cross-wound package on the rotating bobbin tube mounted on said spindle, yarn withdrawal means positioned adjacent said spindle for withdrawing the advancing yarn and such that the advancing yarn contacts a portion of the periphery of the rotating empty bobbin tube which is moving in the same direction as the advancing yarn, and means for reducing the speed of the advancing yarn between the rotating empty bobbin tube and said withdrawal means and so that the advancing yarn slackens and forms a lap on the rotating empty bobbin tube to thereby cause the yarn to be caught by the rotating bobbin tube and commence being wound thereon, said speed reducing means comprising a yarn braking guide pivotally mounted for movement about an axis extending generally parallel to the axis of said spindle, and so that the yarn guide may be moved between a non-operative position free of contact with the advancing yarn and an operative position engaging the yarn and causing the same to be partially looped about the rotating bobbin tube.

7. The apparatus as defined in claim 6 wherein said yarn braking guide includes a circumferential groove for frictionally engaging the advancing yarn.

8. The apparatus as defined in claim 6 wherein said yarn withdrawal means comprises a suction nozzle.

* * * * *